US006786434B2

(12) United States Patent
D'Arrigo

(10) Patent No.: US 6,786,434 B2
(45) Date of Patent: Sep. 7, 2004

(54) DOUBLE CONCENTRIC INLET TUBE FOR SETTING ARMATURE/NEEDLE LIFT AND METHOD OF MANUFACTURING SAME

(75) Inventor: Angelo D'Arrigo, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/946,675

(22) Filed: Sep. 6, 2001

(65) Prior Publication Data

US 2002/0030125 A1 Mar. 14, 2002

Related U.S. Application Data

(62) Division of application No. 09/539,556, filed on Mar. 31, 2000.

(51) Int. Cl.[7] ..... B05B 17/00
(52) U.S. Cl. ..... 239/585.4; 239/5; 239/585.4
(58) Field of Search ..... 239/585.1, 585.2, 239/585.3, 585.4, 585.5, 1, 5

(56) References Cited

U.S. PATENT DOCUMENTS

| | | | | |
|---|---|---|---|---|
| 1,504,773 A | | 8/1924 | Marston | |
| 4,519,547 A | | 5/1985 | Kubach et al. | 239/585 |
| 4,552,312 A | | 11/1985 | Ohno et al. | 239/585 |
| 5,127,585 A | | 7/1992 | Mesenich | 239/585.5 |
| 5,232,167 A | | 8/1993 | McCormick et al. | 239/585.5 |
| 5,307,991 A | * | 5/1994 | Hanson et al. | 239/1 |
| 5,392,995 A | | 2/1995 | Wahba | 239/585.4 |
| 5,775,600 A | * | 7/1998 | Wildeson et al. | 239/585.1 |
| 5,915,626 A | | 6/1999 | Awarzamani et al. | 239/135 |
| 5,944,262 A | | 8/1999 | Akutagawa et al. | 239/585.4 |
| 5,996,910 A | | 12/1999 | Takeda et al. | 239/585.1 |
| 6,019,297 A | | 2/2000 | Hall | 239/585.1 |
| 6,027,049 A | | 2/2000 | Stier | 239/585.1 |
| 6,089,467 A | * | 7/2000 | Fochtman et al. | 239/5 |
| 6,409,101 B1 | * | 6/2002 | D'Arrigo | 239/585.1 |

* cited by examiner

*Primary Examiner*—Christopher Kim

(57) ABSTRACT

An armature lift assembly for a fuel injector is disclosed. The assembly includes a body having an upstream end, a downstream end, and a longitudinal body channel extending therethrough and an armature/needle assembly which is reciprocably disposed in the body along the longitudinal body channel. The assembly further includes a first tube having an upstream end, a downstream end fixedly connected to the upstream end of the body, and a first tube channel. The assembly also includes a second tube located within the first tube channel and fixedly connected to the first tube. The second tube has an upstream end and a downstream end. The downstream end of the second tube is spaced a distance from the upstream end of the armature/needle assembly approximately equal to a lift distance of the armature/needle assembly. A method of setting armature/needle lift in a fuel injector is also disclosed.

7 Claims, 2 Drawing Sheets

DOUBLE CONCENTRIC INLET TUBE FOR SETTING ARMATURE/NEEDLE LIFT AND METHOD OF MANUFACTURING SAME

The present application is a divisional application filed pursuant to 35 U.S.C. §§120 and 121 and claims the benefits of prior application Ser. No. 09/539,556 filed Mar. 31, 2000, which is hereby incorporated by reference in its entirety.

FIELD OF THE INVENTION

The present invention relates to a method for setting armature lift in a fuel injector.

BACKGROUND OF THE INVENTION

In previous armature/needle lift setting operations for a fuel injector, the desired amount of lift of the body/armature/needle subgroup relative to the inlet tube/shell subgroup is set through a step-by-step press operation. The maintenance of the final position of between the two subgroups is obtained through an interference fit between the two subgroups and a final welding process. It is believed that, with this process, the assembling of the subgroups to obtain a desired lift distance requires utmost care and, if the lift distance is established incorrectly, the subgroups cannot be cost effectively disconnected from each other.

It would be beneficial to develop an injector in which the lift setting can be measured and adjusted after assembly and a method of setting the injector lift in which the lift can be adjusted during assembly of the injector.

BRIEF SUMMARY OF THE INVENTION

Briefly, the present invention is an armature lift assembly comprising a body having an upstream end, a downstream end, and a longitudinal body channel extending therethrough and an armature/needle assembly reciprocably disposed in the body along the longitudinal body channel. The armature lift assembly also includes a first tube having an upstream end, a downstream end fixedly connected to the upstream end of the body, and a first tube channel. The assembly also includes a second tube located within the first tube channel and fixedly connected to the first tube. The second tube has an upstream end and a downstream end. The downstream end of the second tube is spaced a distance from the upstream end of the armature/needle assembly approximately equal to a lift distance of the armature/needle assembly.

The present invention also provides a fuel injector comprising an armature lift assembly including a body having an upstream end, a downstream end, and a longitudinal body channel extending therethrough and an armature/needle assembly reciprocably mounted in the body along the longitudinal body channel. The armature lift assembly also includes a first tube having an upstream end, a downstream end fixedly connected to the upstream end of the body, and a first tube channel and a second tube located within the first tube channel and fixedly connected to the first tube. The second tube has an upstream end and a downstream end. The downstream end of the second tube is spaced approximately equal to the armature/needle assembly lift distance from the upstream end of the armature/needle assembly. The fuel injector also includes a seat proximate to the armature/lift assembly so that the armature/needle assembly engages the seat in a closed position.

The present invention also provides a method of setting armature lift in a fuel injector having a first tube fixedly connected to a body, the body containing an armature reciprocably disposed therein, the method comprising: inserting a second tube into the first tube, a downstream end of the second tube engaging the armature; inserting a lift gage through the second tube; and separating the second tube from the armature, the lift gage biasing the armature away from the second tube, such that the lift gage measures a gap between the second tube and the armature.

The present invention also provides a method of setting armature/needle lift in a fuel injector having an external inlet tube, an internal inlet tube having an upstream end and a downstream end, an armature/needle assembly including an armature having an upstream end and a needle having an upstream end connected to the armature, and a seat, the method comprising: inserting a lift pin into the upstream end of the internal inlet tube; inserting a lift check gage through the lift pin into the internal inlet tube such that a downstream end of the lift check gage engages the upstream end of the needle and such that the armature/needle assembly is biased downstream, the needle engaging the valve seat; fixedly positioning an upstream end of the lift check gage; moving the internal inlet tube downstream such that the downstream end of the internal inlet tube engages the armature; moving the lift pin and the internal inlet tube upstream a predetermined distance as measured by the lift check gage; removing the lift check gage and the lift pin from the internal inlet tube; and securing the internal inlet tube to the external inlet tube.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENTS

Figure 1:
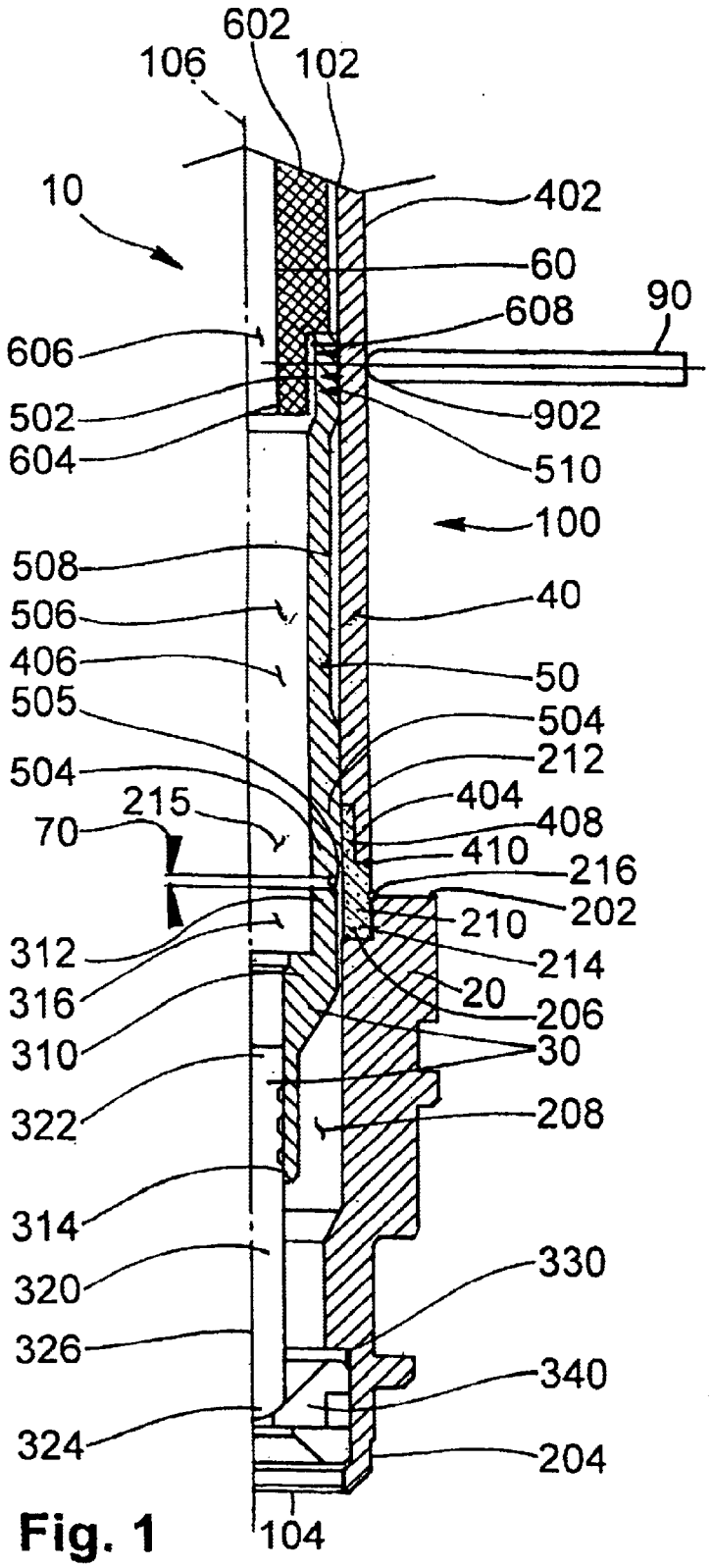
FIG. 1 is a partial side view, in partial section, of a fuel injector armature lift assembly according to a preferred embodiment of the present invention.

In the drawings, like numerals are used to indicate like elements throughout. Referring now to FIG. 1, a section of a fuel injector 10 which is relevant to the present invention is shown. The fuel injector 10 includes an upstream end 102, a downstream end 104 and a generally longitudinal axis 106 extending therethrough. As used herein, the term "upstream" refers to a direction toward the top of the figure to which is being referred, and "downstream" refers to a direction toward the bottom of the figure to which is being referred. As those skilled in the art understand and recognize the general design and operation of fuel injectors, the entire fuel injector 10 is not shown. Only the portion of the fuel injector 10 which is pertinent to the present invention is shown. Additionally, although the preferred use of the present invention is in a fuel injector 10, those skilled in the art will recognize that the present invention can be used in other devices in which a lift height must be set.

The fuel injector 10 includes an armature/lift assembly 100 which is comprised of a valve body 20, an armature/needle assembly 30, an external inlet tube 40, and an internal inlet tube 50. The valve body 20 has an upstream end 202 and a downstream end 204 and includes a generally annular recess 206 which extends around an interior portion proximate to the upstream end 202. A longitudinal channel 208 extends therethrough. A non-magnetic shell 210, having an upstream end 212, a downstream end 214, and a shell channel 215 is fixedly inserted into the valve body 20 such that the downstream end 214 of the non-magnetic shell 210 is located within the annular recess 206. The valve body 20 and the non-magnetic shell 210 are preferably welded together at weld 216, although those skilled in the art will recognize that the valve body 20 and the non-magnetic shell 210 can be fitted and connected together by other suitable means.

The armature/needle assembly 30 is reciprocably disposed within the valve body 20 along the body channel 208. The armature/needle assembly is composed of a hollow armature 310 and a hollow needle 320. The armature has an upstream end 312, a downstream end 314, and a longitudinal channel 316 extending therethrough. The needle 320 has an upstream end 322, and a downstream end 324, and a longitudinal axis 326 extending therethrough. The longitudinal channel 316 and the longitudinal axis 326 are preferably along the longitudinal axis 106 of the assembly 100. The downstream end 314 of the armature 310 is fixedly connected to the upstream end 322 of the needle 320 so that the armature 310 and the needle 320 reciprocate together. The downstream end 324 of the needle 320 has a diameter sized to fit through a needle guide 330, which guides the needle 30 along the longitudinal axis 106 during operation. A generally frusto-conical valve seat 340 is located downstream of the needle 320. The downstream tip of the needle 320 engages the valve seat 340 during operation to preclude fuel flow through the injector 10 and disengages from the valve seat 340 during operation to allow fuel flow through the injector 10.

A first, or external inlet, tube 40 has an upstream end 402, a downstream end 404, and a longitudinal channel 406 extending therethrough. The downstream end 404 includes a generally annular recess 408 which extends around an interior portion proximate to the downstream end 404. The upstream end 212 of the non-magnetic shell 210 is fixedly inserted into the recess 408 and the non-magnetic shell 210 and the external inlet tube 40 are preferably welded together at weld 410, although those skilled in the art will recognize that the non-magnetic shell 210 and the external inlet tube 40 can be fitted and connected together by other suitable means.

Although the valve body 20 and the non-magnetic shell 210 are preferably connected by weld 216, and the non-magnetic shell 210 and the external inlet tube 40 are connected by weld 410, those skilled in the art will recognize that other connecting methods, such as furnace brazing, swaging, gluing, or interference fits can be used. The assembling process for the valve body 20, the non-magnetic shell 210, and the external inlet tube 40 can be performed in a single operation. Additionally, the welding of the valve body 20 to the non-magnetic shell 210 and the non-magnetic shell 210 to the external inlet tube 40 can be performed in a single operation.

A second, or internal inlet, tube 50 has an upstream end 502, a downstream end 504 and a channel 506 extending therethrough. The internal inlet tube 50 is insertable into the external inlet tube channel 406 such that the outer perimeters of the upstream end 502 and the downstream end 504 engage the wall of the channel 406 in the external inlet tube 40 in a slight interference fit, that is to say, there is no play between the outer perimeters of the upstream end 502 and the wall of the channel 406 and between the downstream end 504 and the wall of the channel 406. An intermediate portion 508 of the internal inlet tube is spaced from the wall of the channel 406 so as not to generate an excessive amount of frictional contact between the internal inlet tube 50 and the external inlet tube 40. Preferably, the interior walls of the valve body 20, the shell 210, and the exterior inlet tube 40 which form the channels 208, 215, and 406 are coextensive to allow insertion of the armature/needle assembly 30 and the interior inlet tube 50 therein.

The diameter of the channel 506 at the upstream end 502 is preferably at least slightly larger than the diameter of the channel 506 at the intermediate portion 508 and at the downstream end 504 for reasons that will be explained. Also preferably, at least a portion of the exterior of the upstream end 502 has a knurled surface 510, for reasons that will be explained. Although the channel 506 of the internal inlet tube 40 preferably has a generally circular cross-section, those skilled in the art will recognize that non-circular shapes, such as parallelograms, triangles, gear tooth, spline, or other hollow shapes can be used.

Preferably, each of the external inlet tube 40 and the internal inlet tube 50 are constructed from magnetic corrosion resistant steel, such as 430 FR annealed solenoid quality steel, although those skilled in the art will recognize that other suitable materials can be used. Each of the external inlet tube 40 and the internal inlet tube 50 can be a seamless welded tube, a longitudinally welded tube, a tube formed from a rolled thin sheet, machined from roundbar, or any other suitable type of tube. Also preferably, a bottom surface 505 of the internal inlet tube 50, which is impacted by the armature/needle assembly 30 during operation, is chrome plated, to extend the life of the internal inlet tube 50. Additionally, the bottom surface 505 has a generally flat face to reduces any potential geometric problems between the bottom surface 505 and the upstream end 312 of the armature 310 during operation of the injector assembly 10.

A lift pin 60 is used to set the location of the internal inlet tube 50 relative to the external inlet tube 40, thus setting a gap 70 between the downstream end 504 of the internal inlet tube 50 and the upstream end 312 of the armature 310. The gap 70 is the lift height of the armature/needle assembly 30. The lift pin 60 includes an upstream end 602, a downstream end 604, and a longitudinal channel 606 extending therethough. A generally annular recess 608 is located around the outer perimeter of the downstream end 604 such that the downstream end 604 is removably insertable into the upstream end 502 of the internal inlet tube 50. Preferably, at least a slight interference exists between the downstream end 604 of the lift pin 60 and the upstream end 502 of the internal inlet tube 50, such that the lift pin 60 can move the internal inlet tube 50 relative to the external inlet tube 40 to set the gap 70 as will be described later herein. Those skilled in the art will recognize that the downstream end 604 of the lift pin 60 can be spring loaded or otherwise biased away from the longitudinal axis 106 and toward the internal inlet tube 50, such as with an expanding collet, to provide sufficient gripping between the lift pin 60 and the internal inlet tube 50 such that the lift pin 60 can move the internal inlet tube 50 relative to the external inlet tube 40. Alternatively, the downstream end 604 of the lift pin 60 can be magnetically activated to releasably engage the internal inlet tube 50. However, the contact between the internal inlet tube 50 and the lift pin 60 should be slight enough so that the lift pin 60 can be easily removed from the internal inlet tube 50 when the gap 70 has been set.

Setting of the size of the gap 70 between the internal inlet tube 50 and the armature/needle assembly 30 will now be described. The valve body 20, the non-magnetic shell 210, and the external inlet tube 40 are connected and secured together as described above. The armature/needle assembly 30 is then installed in the valve body 20 through the external inlet tube 40. The downstream end 324 of the needle 320 engages the valve seat 340 in a sealing condition. The internal inlet tube 50 is then inserted into the external inlet tube 40, with the lift pin 60 connected to the upstream end 502 of the internal inlet tube 50 as described above. The internal inlet tube 50 is pushed into the external inlet tube 40 until the bottom surface 505 of the internal inlet tube 50 contacts the top of the armature/needle assembly 30. Preferably, the upstream end 502 of the internal inlet tube 50 is farther downstream than the upstream end 402 of the external inlet tube 40.

Figure 2:
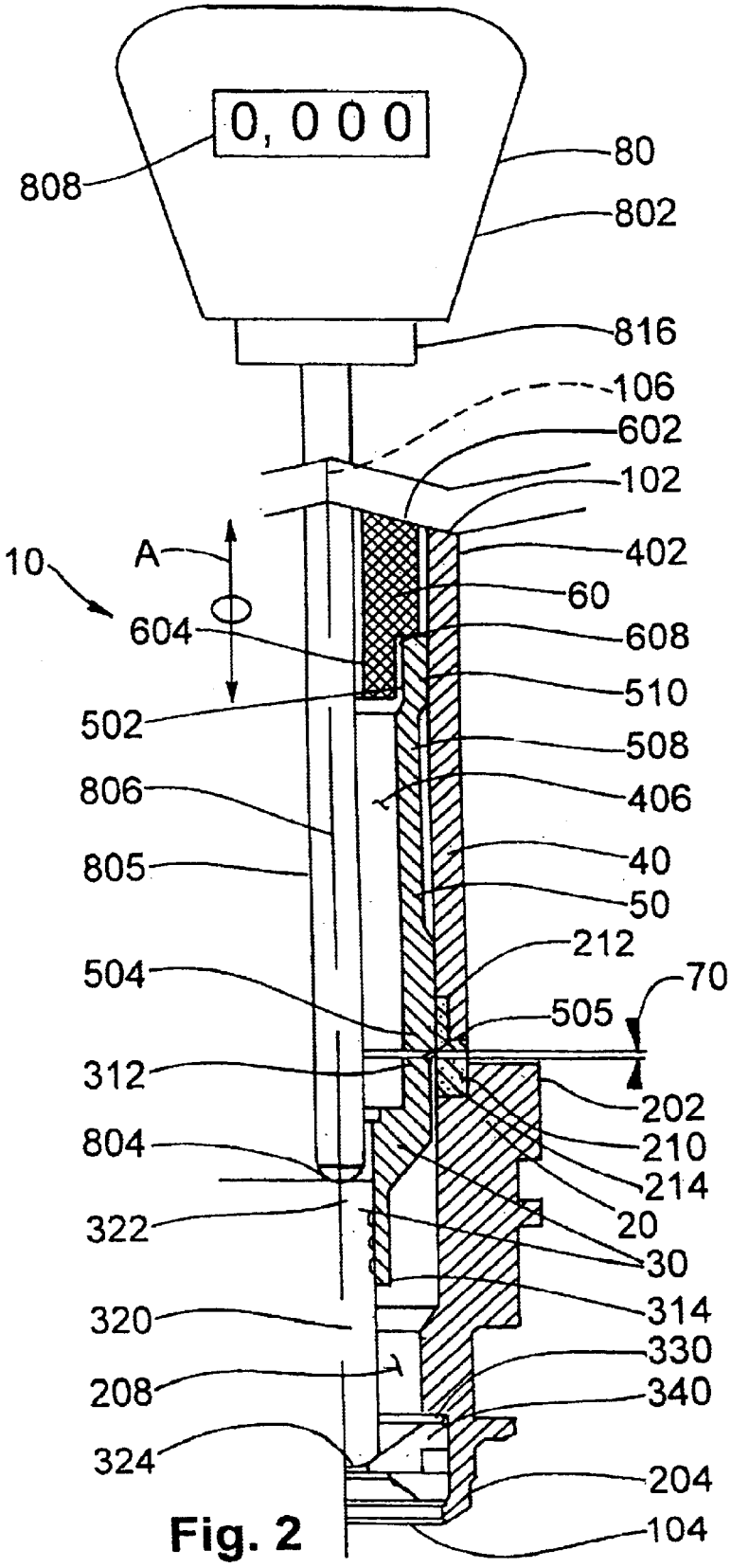
FIG. 2 is a partial side view, in partial section, of the fuel injector armature lift assembly with a lift gage inserted therein.

To measure the gap 70, a lift check gage device 80, shown in FIG. 2, having an upstream end 802, a downstream end 804, a spring-biased probe 805 which biases the downstream end 804 away from the upstream end 802, and a longitudinal axis 806 extending therethrough, is inserted into the upstream end 602 of the lift pin 60, and through the length of the lift pin 60 and the internal inlet tube 50 until the downstream end 804 engages the upstream end 322 of the needle 320. The probe 805 is spring biased away from the upstream end 802 of the gage device 80, forcing the armature/needle assembly 30 against the valve seat 340. A gage 808 is located at the upstream end 802 of the device 80. The upstream end 802 of the device 80 is held in position by a mechanical means (not shown) so that the device 80 does not move axially during the gap setting procedure. Alternatively, although not shown, the device 80 can be located so that a lip 810 can rest on the upstream end 602 of the lift pin 60.

The internal inlet tube 50 and the lift pin 60 are then moved downstream until the downstream end 504 of the internal inlet tube 50 engages the upstream end 312 of the armature 310. The gage 808 is then preferably set to zero, as shown in FIG. 2, once the downstream end 804 engages the upstream end 312 of the armature 310. The lift pin 60 is then moved longitudinally upstream until the gage 808 reads a desired lift height. Since the internal inlet tube 50 is attached to the lift pin 60, the internal inlet tube 50 moves upstream the same distance as the lift pin 60, moving the downstream end 504 of the internal inlet tube 50 away from the armature 310. The distance between the internal inlet tube 50 and the armature 310 is the lift height or gap 70.

Once the gap 70 is set, a slave coil (not shown) is magnetically activated to operate the armature/needle assembly 30. After this check, if the desired gap 70 is not present, the internal inlet tube 50 can be moved upstream or downstream relative to the external inlet tube 40, as indicated by the arrow "A" in FIG. 2, thus adjusting the gap 70. If, for some reason, the desired size of the gap 70 cannot be obtained, the fuel injector 10 can be disassembled and some or all of the individual parts that comprise the fuel injector 10 can be reused.

Once the desired gap 70 is achieved, the lift check gage device 80 and the lift pin 60 are removed from the injector 10. A crimping tool 90, shown in FIG. 1, engages the exterior of the external inlet tube 40 at the crimping location 902 and compresses the external inlet tube 40 toward the longitudinal axis 106 against the knurled surface 510 of the upstream end 502 of the internal inlet tube 50, crimping the external inlet tube 40 and the internal inlet tube 50 together. The knurled surface 510 assists in maintaining a fixed and solid connection between the external inlet tube 40 and the internal inlet tube 50. During the crimping process, the channel 506 proximate to the upstream end 502 is compressed toward the longitudinal axis 106. However, since the diameter of the channel 506 proximate to the upstream end 502 is generally larger than the diameter of the channel 506 at the intermediate portion 508 and the downstream end 504, the channel 506 will still be sufficiently large after crimping to provide required fuel flow through the channel 506 for injection.

The present invention, as described above, makes the inlet tubes 40, 50, the valve body 20 and the non-magnetic shell 210 economical parts compared to the prior art, and allows for a quicker and more cost effective assembly of the components. Additionally, the presently disclosed method of setting the armature/needle assembly 30 lift provides an improved ability to obtain the desired lift as compared to prior art methods.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A method of setting armature lift in a fuel injector having a first tube with an upstream end and a downstream end extending along a longitudinal axis, the first tube fixedly connected to a body, the body containing an armature reciprocally disposed therein, the armature having an upstream end and a downstream end, the method comprising:

inserting a second tube into the first tube, the second tube having first and second ends contacting an inner surface of the first tube along the longitudinal axis, and a middle portion disposed between the first and second ends, the middle portion being spaced from the first tube so that the middle portion avoids contact with the first tube, the second tube including a downstream end of the second tube engaging the upstream end of the armature, the second tube being contiguous to a non-magnetic shell along the longitudinal axis, and the non-magnetic shell having a portion contiguous to the body along the longitudinal axis;

inserting a lift gage through the second tube, the lift gage biasing the armature away from the second tube in a direction toward the downstream end of the armature, such that the lift gage measures a gap between the second tube; and separating the second tube away from the armature towards the upstream end of the first tube and away from the armature so as to provide a gap between a downstream end of the second tube and the upstream end of the armature.

2. The method according to claim 1, further comprising removing the lift gage and fixedly connecting the second tube to the first tube.

3. The method according to claim 2, wherein connecting the second tube to the first tube is performed by crimping so that a volume of empty space is provided between an outer surface of the middle portion and an inner surface of the first tube.

4. The method according to claim 1, further comprising altering the gap by moving the second tube relative to the first tube.

5. The method according to claim 4, further comprising, before moving the second tube relative to the first tube, connecting a lift pin to the second tube, the lift pin being adapted to move the second tube relative to the first tube.

6. A method of setting armature/needle lift in a fuel injector having an external inlet tube fixedly connected to a body, an internal inlet tube having an upstream end and a downstream end extending along a longitudinal axis, an armature/needle assembly including an armature having an upstream end and a needle having an upstream end connected to the armature, and a seat disposed in the body, the method comprising:

inserting a lift pin into the upstream end of the internal inlet tube;

inserting a lift check gauge through the lift pin into the internal inlet tube such that a downstream end of the lift check gage engages the upstream end of the needle and such that the armature/needle assembly is biased downstream, the needle engaging the valve seat;

fixedly positioning an upstream end of the lift check gage;

moving the internal inlet tube downstream such that the downstream end of the internal inlet tube engages the armature, the internal inlet tube having first and second ends contacting an inner surface of the external inlet tube along the longitudinal axis, and a middle portion disposed between the first and second ends, the middle portion being spaced from the external inlet tube so that the middle portion avoids contact with the external inlet tube, the external inlet tube contiguous to a non-magnetic shell along the longitudinal axis, and the non-magnetic shell has a portion contiguous to the body along the longitudinal axis;

moving the lift pin and the internal inlet tube upstream a predetermined distance as measured by the lift check gage;

removing the lift check gage and the lift pin from the internal inlet tube; and securing the internal inlet tube to the external inlet tube.

7. The method according to claim 6, further comprising, after moving the lift pin and the internal inlet tube upstream, moving the lift pin and the internal inlet tube at least one of upstream and downstream such that the lift check gage provides a desired reading.

* * * * *